US005583969A

United States Patent [19]

Yoshizumi et al.

[11] Patent Number: 5,583,969

[45] Date of Patent: Dec. 10, 1996

[54] SPEECH SIGNAL PROCESSING APPARATUS FOR AMPLIFYING AN INPUT SIGNAL BASED UPON CONSONANT FEATURES OF THE SIGNAL

[75] Inventors: Yoshiyuki Yoshizumi, Suita; Tsuyoshi Mekata; Yoshinori Yamada, both of Katano; Ryoji Suzuki, Nara, all of Japan

[73] Assignee: Technology Research Association of Medical and Welfare Apparatus, Tokyo, Japan

[21] Appl. No.: 52,698

[22] Filed: Apr. 26, 1993

[30] Foreign Application Priority Data

Apr. 28, 1992 [JP] Japan ..... 4-109451

[51] Int. Cl.[6] ..... G10L 9/00

[52] U.S. Cl. ..... 395/2.63; 395/2.34; 395/2.35; 395/2.8

[58] Field of Search ..... 395/2.34, 2.55–2.64, 395/2.35–2.37, 2.8; 381/41–43

[56] References Cited

U.S. PATENT DOCUMENTS

| | | | |
|---|---|---|---|
| 3,679,830 | 7/1972 | Uffelman et al. | 381/41 |
| 4,001,505 | 1/1977 | Araseki et al. | 381/46 |
| 4,181,813 | 1/1980 | Marley | 395/2.6 |
| 4,589,136 | 5/1986 | Poldy et al. | 381/71 |
| 4,769,844 | 9/1988 | Fujimoto et al. | 395/2.63 |
| 4,780,906 | 10/1988 | Rajasekaran et al. | 395/2.6 |
| 4,817,155 | 3/1989 | Briar et al. | 395/2.17 |
| 4,937,869 | 6/1990 | Iwahashi et al. | 395/2.63 |
| 5,146,504 | 9/1992 | Pinckley | 395/2.34 |
| 5,159,638 | 10/1992 | Naito et al. | 381/46 |
| 5,278,910 | 1/1994 | Suzuki et al. | 395/2.4 |
| 5,408,581 | 4/1995 | Sukuki et al. | 395/2.35 |

OTHER PUBLICATIONS

Parsons, *Voice and Speech Processing*, McGraw–Hill, New York, NY (1987), pp. 119–121.

R. W. Guelke, *Journal of Rehabilitation Research and Development*, vol. 24, No. 4, pp. 217–220, Fall 1987, "Consonant Burst Enhancement: A Possible Means To Improve Intelligibility For The Hard of Hearing".

*Primary Examiner*—Allen R. MacDonald
*Assistant Examiner*—Michael A. Sartori
*Attorney, Agent, or Firm*—Renner, Otto, Boisselle, Sklar

[57] ABSTRACT

An apparatus for processing a speech signal includes a coefficient calculating circuit for receiving an input signal, and for generating a first value for suppressing a change of level of the input signal; a first delay circuit for receiving the input signal, and for delaying the input signal by a predetermined time; a feature extracting circuit for receiving the input signal, and for deriving a feature value representing a feature of consonants from the input signal; a coefficient control circuit for receiving the first value from the coefficient calculating circuit and the feature value from the feature extracting circuit, and for changing the amplitude and the duration of the first value depending on the feature value, so as to generate a second value; a multiplying circuit for receiving the delayed input signal from the first delay circuit and the second value from the coefficient control circuit, and for multiplying the delayed input signal by the second value.

3 Claims, 8 Drawing Sheets

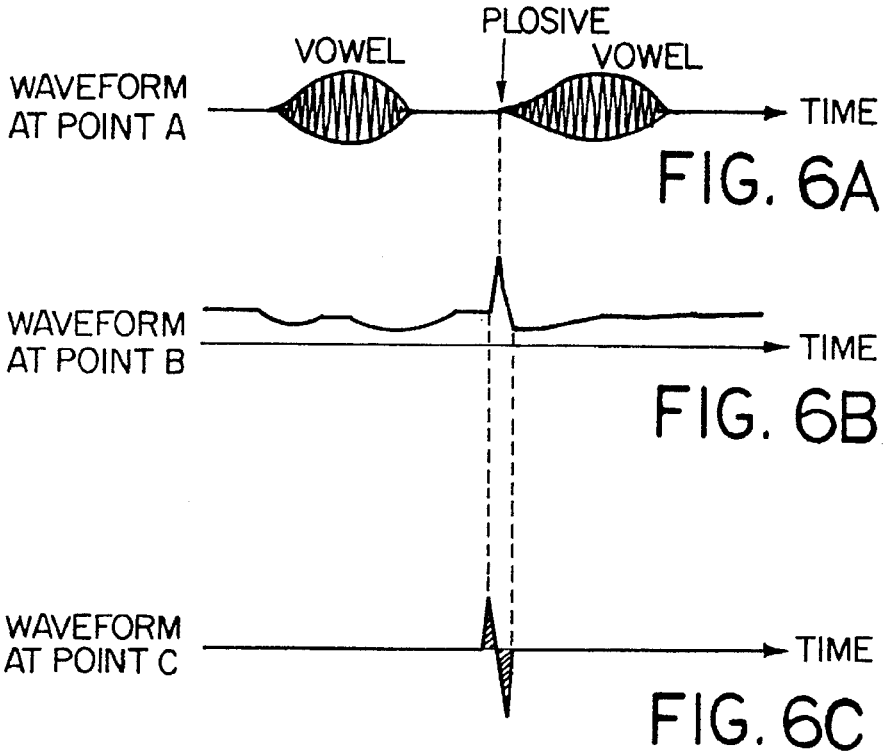
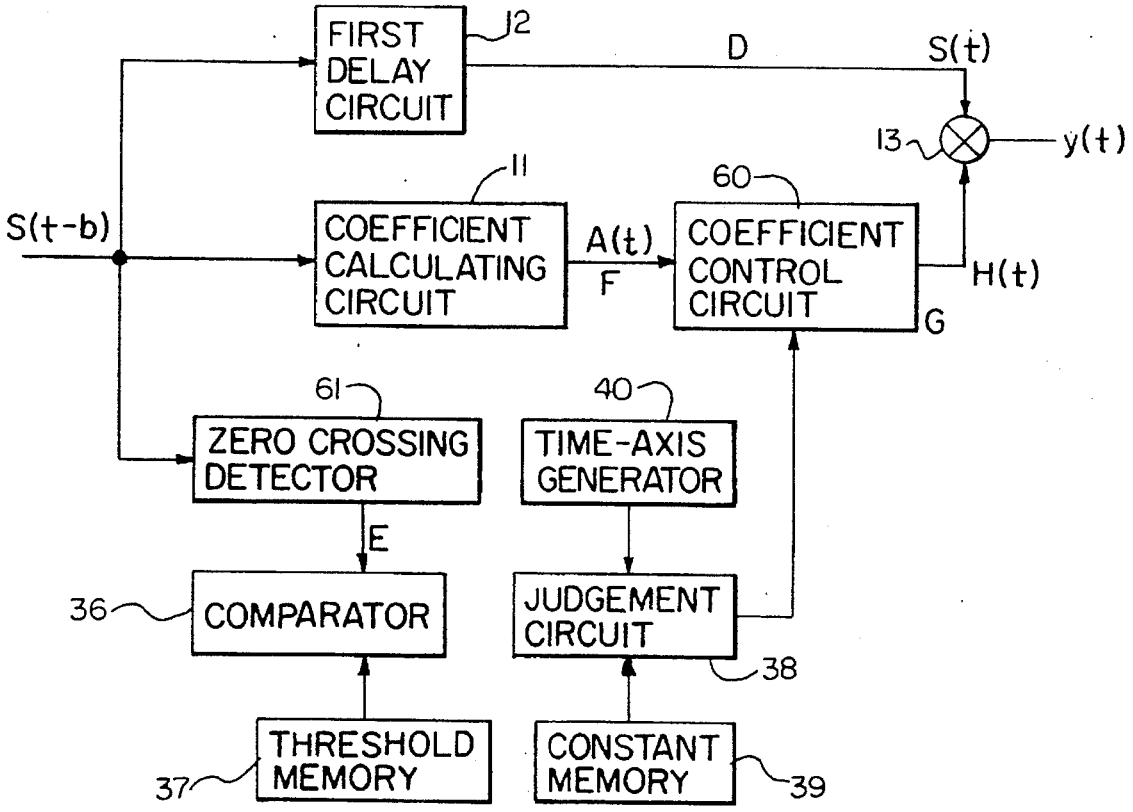
FIG. 7

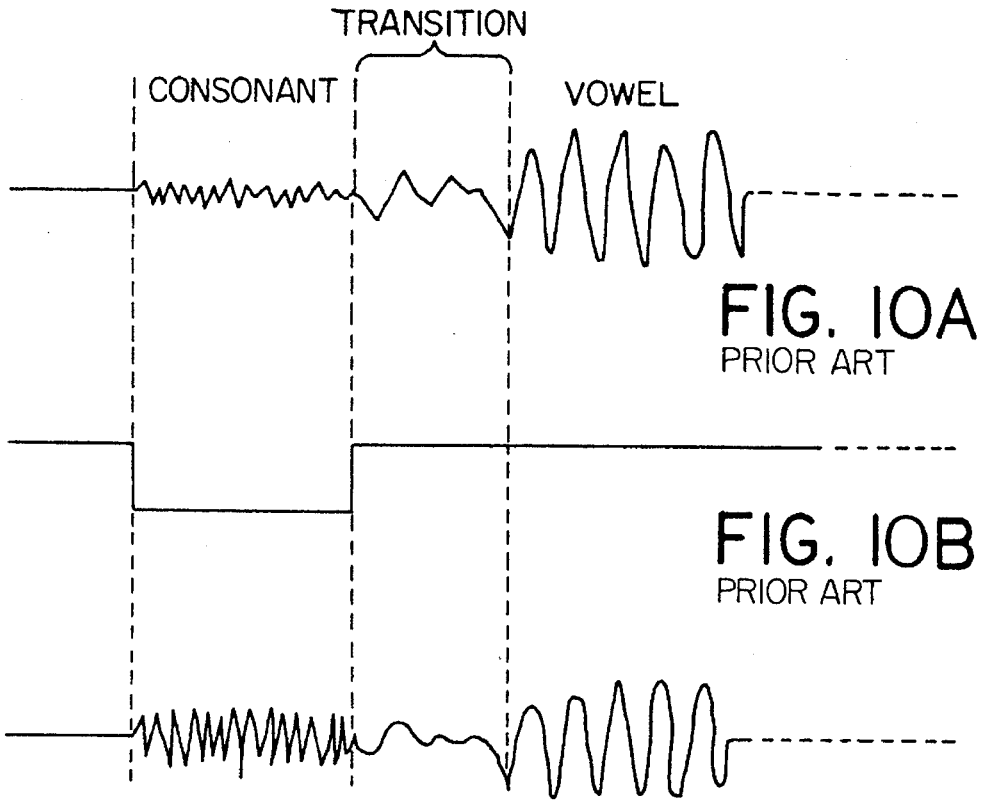
FIG. 10A
PRIOR ART
FIG. 10B
PRIOR ART
FIG. 10C
PRIOR ART
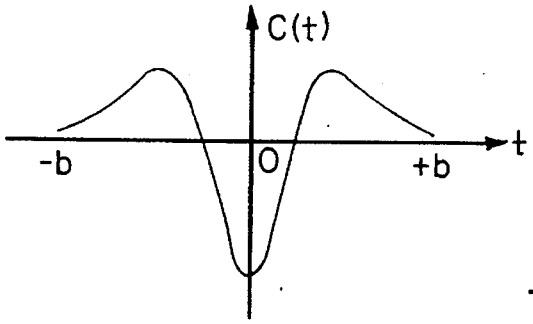
FIG. 12
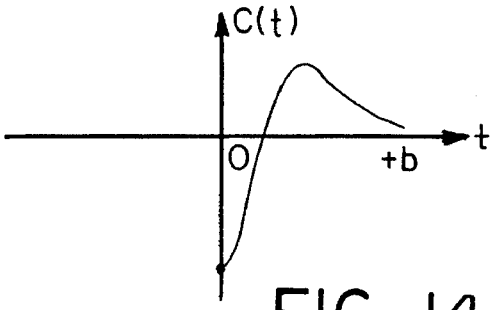
FIG. 14
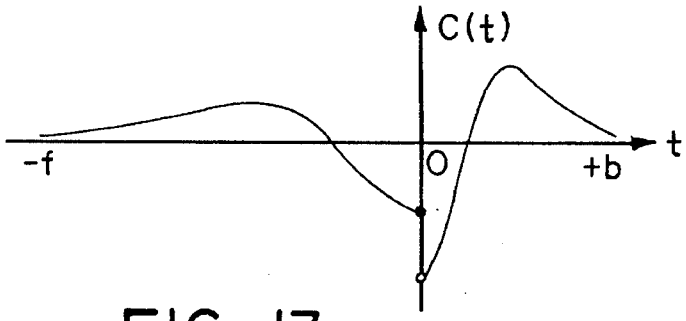
FIG. 13
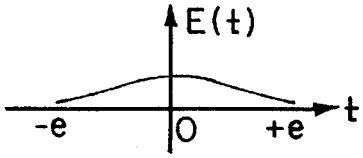
FIG. 15

| | TIME CONSTANT |
|---|---|
| p | $\tau 1$ |
| t | $\tau 2$ |
| k | $\tau 3$ |

WHERE $\tau 1 < \tau 2 < \tau 3$

SPEECH SIGNAL PROCESSING APPARATUS FOR AMPLIFYING AN INPUT SIGNAL BASED UPON CONSONANT FEATURES OF THE SIGNAL

BACKGROUND OF THE INVENTION

1. Field of the Invention

The present invention relates to a speech signal processing apparatus and a feature extracting circuit used for the same for improving the intelligibility of a speech signal.

2. Description of the Related Art

FIG. 9 shows a basic configuration of a conventional speech signal processing apparatus. The speech signal processing apparatus includes an amplifier 101 for amplifying a speech signal, a gap detector 102 for detecting a silence component, an envelope follower 103 for following an envelope of the speech signal, a zero crossing detector 104 for determining the zero crossing frequency of the speech signal, and a differentiator 105 for determining the rate of change in the speech signal. The speech signal processing apparatus further includes a one-shot mono/multivibrator 105 which generates a pulse on the basis of the outputs from the gap detector 102, the differentiator 105, and the zero crossing detector 104 so as to control the amplifier 101.

The operation of such a conventional speech signal processing apparatus will be described with reference to FIGS. 10A to 10C. FIG. 10A is a waveform of an input speech signal. The input speech signal is sent to the amplifier 101, the gap detector 102, the envelope follower 103, and the zero crossing detector 104. The gap detector 102 detects a silence component of the received speech signal and outputs the result to the one-shot mono/multivibrator 106. The envelope follower 103 follows an envelope of the received speech signal and outputs the result to the differentiator 105. The differentiator 105 determines the rate of change in the envelope and outputs the result to the one-shot mono/multivibrator 106. The zero crossing detector 104 determines the zero crossing frequency of the received speech signal and outputs the result to the one-shot mono/multivibrator 106. Based on the outputs from the gap detector 102, the differentiator 105, and the zero crossing detector 104, the one-shot mono/multi vibrator 106 generates a pulse having a waveform as shown in FIG. 10B. The pulse is generated when a silence component of the speech signal shifts to a sound component thereof and lasts until both the zero crossing frequency and the rate of change in the envelope become sufficiently high. The pulse generated by the one-shot mono/multivibrator 106 is sent to the amplifier 101, On receipt of the pulse, the amplifier 101 amplifies the input speech signal with a predetermined amount of gain, and outputs an amplified speech signal having a waveform as shown in FIG. 10C. When no pulse is sent to the amplifier 101, the original speech signal input to the amplifier 101 is output therefrom with a gain of 1, i.e., without any amplification.

Such a conventional speech signal processing apparatus can detect fricatives, but the detection of consonants with a short burst and a small amplitude such as plosives is difficult. Further, plosives have their own VOTs (voice onset time) which are different from one another. Such VOTs can not be detected by conventional speech signal processing apparatus. As a result, it is not possible for the amplifier 101 to amplify each consonant for its specific duration by correctly controlling the amplification time during which the consonant is amplified corresponding to the duration of the consonant. Furthermore, when a fricative is only partially amplified, a different sound from the original may be produced.

SUMMARY OF THE INVENTION

The apparatus for processing a speech signal of this invention, includes: a coefficient calculating circuit for receiving an input signal, and for generating a first value for suppressing a change of level of the input signal; a first delay circuit for receiving the input signal, and for delaying the input signal by a predetermined time; a feature extracting circuit for receiving the input signal, and for deriving a feature value representing a feature of consonants from the input signal; a coefficient control circuit for receiving the first value from the coefficient calculating circuit and the feature value from the feature extracting circuit, and for changing the amplitude and the duration of the first value depending on the feature value, so as to generate a second value; a multiplying circuit for receiving the delayed input signal from the first delay circuit end the second value from the coefficient control circuit, and for multiplying the delayed input signal by the second value.

In another aspect of this invention, an apparatus for extracting a feature value of plosives, includes: a first band pass circuit for receiving the input signal, and for allowing components having a predetermined frequency of the input signal to pass therethrough; a second band pass circuit for receiving the input signal, and for allowing components having another predetermined frequency of the input signal to pass therethrough; a first average amplitude calculating circuit for calculating a first average amplitude of the input signal passing through the first band pass circuit in a period; a second average amplitude calculating circuit for calculating a second average amplitude of the input signal passing through the second band pass circuit in the period; a dividing circuit for obtaining the ratio of the first average amplitude to the second average amplitude; a first memory circuit for storing a constant as a threshold value; a comparing circuit for comparing the ratio of the first average amplitude to the second average amplitude with the threshold value, and for generating a signal indicating whether the ratio exceeds the threshold value; a second memory circuit for storing a plurality of constants as time period values; a pulse generating circuit for generating a pulse signal which defines a time unit on the time-axis; a judgement circuit for receiving the signal from the comparing circuit and the pulse signal from the pulse generating circuit each time unit, for determining a time period how long the ratio continues to exceed the threshold value on the basis of the signal and the pulse signal, and for identifying the kind of plosives by comparing the time period with at least one of the plurality of time period values stored in the second memory circuit.

In another aspect of this invention, an apparatus for extracting a feature value of plosives, includes: a first band pass circuit for receiving the input signal, and for allowing components having a predetermined frequency of the input signal to pass therethrough; a second band pass circuit for receiving the input signal, and for allowing components having another predetermined frequency of the input signal to pass therethrough; a first average amplitude calculating circuit for calculating a first average amplitude of the input signal passing through the first band pass circuit in a period; a second average amplitude calculating circuit for calculating a second average amplitude of the input signal passing through the second band pass circuit in the period; a dividing circuit for obtaining the ratio of the first average amplitude to the second average amplitude; a differentiating circuit for differentiating the ratio with regard to a time axis; an absolute value circuit for generating an absolute value of the differentiated ratio; a first memory circuit for storing a constant as a threshold value; a comparing circuit for comparing the absolute value with the threshold value, and for generating a signal indicating whether the absolute value exceeds the threshold value; a second memory circuit for storing a plurality of constants as time period values; a pulse generating circuit for generating a pulse signal which defines a time unit on the time-axis; a judgement circuit for receiving the signal from the comparing circuit and the pulse signal from the pulse generating circuit each time unit, for determining a time period of how long the absolute value continues to exceed the threshold value on the basis of the signal and the pulse signal, and for identifying the kind of plosives by comparing the time period with at least one of the plurality of time period values stored in the second memory circuit.

In another aspect of this invention, an apparatus for processing a speech signal, includes: a feature extracting circuit for receiving an input signal, and for deriving a feature value representing a feature of consonants from the input signal; a determining circuit for determining a first parameter for specifying a time period during which the input signal is amplified and a second parameter for specifying a gain with which the input signal is amplified, according to the feature value; an amplifying circuit for amplifying the input signal based on the first parameter end the second parameter.

According to the speech signal processing apparatus of the present invention, plosives can be identified by separately filtering higher-frequency components of an input speech signal and lower-frequency components thereof, and calculating the ratio of the short-period average amplitude of the higher-frequency components to that of the lower-frequency components, as well as the duration of the components. Based on the data obtained by the calculation, the time period during which the compensation coefficient is kept applied, i.e., the duration of the compensation coefficient, can be properly controlled depending on the plosives, so that plosives can be stably emphasized without the VOT being changed.

Thus, the invention described herein makes possible the advantages of (1) providing a speech signal processing apparatus in which the amplification time and the gain can be properly controlled depending on the types of consonants, (2) providing a speech signal processing apparatus in which partial amplification of a fricative can be avoided so that the trouble of producing different sound from the original can be prevented, (3) providing a feature extracting circuit which can identify a plosive and the duration of the plosive, and thereby (4) providing a speech signal processing apparatus which can amplify plosives without spoiling the naturalness and thus improve the intelligibility of the speech.

These and other advantages of the present invention will become apparent to those skilled in the art upon reading and understanding the following detailed description with reference to the accompanying figures.

BRIEF DESCRIPTION OF THE DRAWINGS

FIGS. 6A to 6C are waveforms of a speech signal at different stages in the process by the plosive feature extracting circuit of FIG. 5.

FIG. 7 is a block diagram of another speech signal processing apparatus according to the present invention.

FIGS. 10A to 10C are waveforms of a speech signal at different stages in the process by the conventional speech signal processing apparatus.

FIG. 12 is a characteristic diagram of content C(t) of first memory of the apparatus for speech signal processing in the embodiment of the invention.

FIG. 13 is another characteristic diagram of content C(t) of first memory.

FIG. 14 is a different characteristic diagram of content C(t) of first memory.

FIG. 15 is a characteristic diagram of content E(t) of second memory.

DESCRIPTION OF THE PREFERRED EMBODIMENTS

The present invention will be described by way of examples with reference to the accompanying drawings.

EXAMPLE 1

Figure 1:
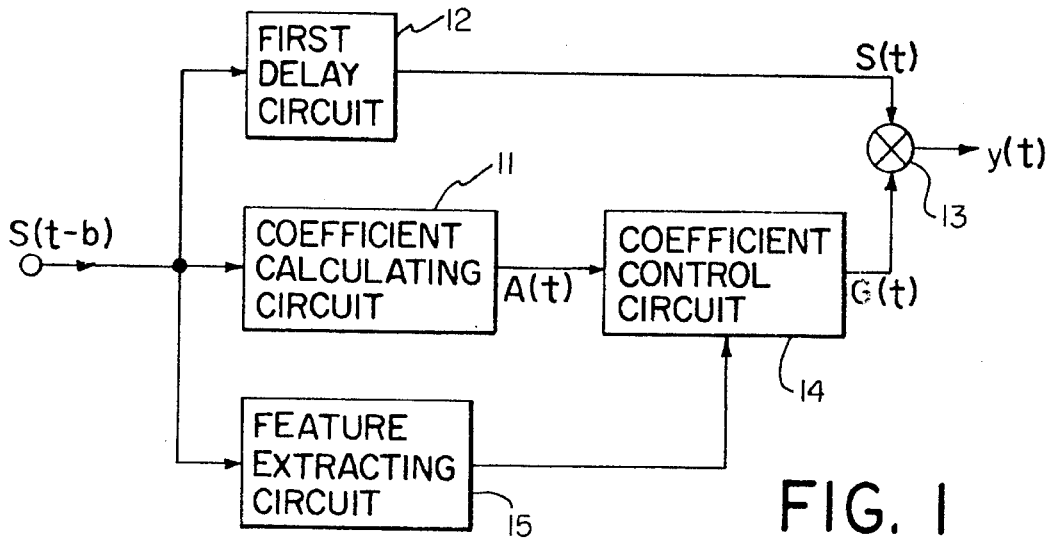
FIG. 1 is a block diagram of a speech signal processing apparatus according to the present invention.
Figure 2A:
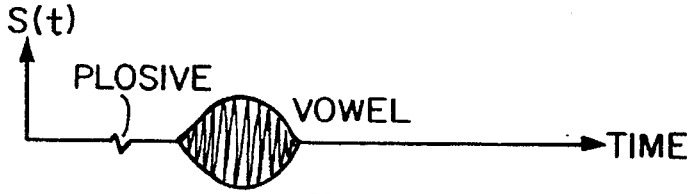
FIGS. 2A to 2D are waveforms of a speech signal at different stages in the process by the speech signal processing apparatus of FIG. 1.
Figure 2B:
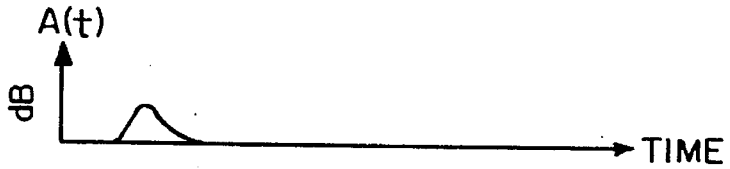
Figure 2C:
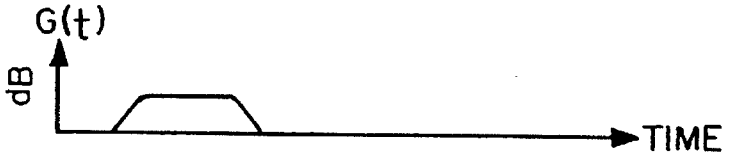
Figure 2D:
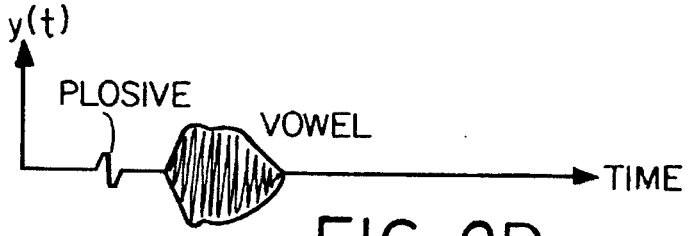

FIG. 1 shows a block diagram of a speech signal processing apparatus according to the present invention. Referring to FIG. 1, the speech signal processing apparatus includes a coefficient calculating circuit 11 for calculating a compensation coefficient from an input speech signal, a first delay circuit 12 for delaying the input speech signal, and a feature extracting circuit 15 for deriving a feature value representing a feature of consonants from the input speech signal. The speech signal processing apparatus further includes a coefficient control circuit 14 for controlling the duration and the amplitude of the compensation coefficient output from the coefficient calculating circuit 11 based on the feature value output from the feature extracting circuit 15, and a multiplier 13 for multiplying the output from the first delay circuit 12 by the output from the coefficient control circuit 14.

The operation of the speech signal processing apparatus of this example will be described.

An input speech signal S(t–b) is sent to the coefficient calculating circuit 11, the first delay circuit 12, and the feature extracting circuit 15. S(t) represents an input signal at the time t, end b represents a delay time mentioned below. The coefficient calculating circuit 11 receives the input speech signal S(t–b), and generates a compensation coefficient A(t) on the basis of the speech signal at the time t and also just before and after the time t. The compensation coefficient A(t) is used to suppress a change of the level of a speech signal S(t). The first delay circuit 12 receives the input speech signal S(t–b), and delays the input speech signal S(t–b) by the time b required for the processing of the speech signal so as to output the speech signal S(t).

The feature extracting circuit 15 receives the input speech signal S(t–b), and derives a feature value representing a feature of consonants from the input speech signal S(t–b). For example, the feature value represents a feature indicating whether the input speech signal includes stop consonants or plosives. Further, the feature value may represent a feature indicating what kind of plosives the input speech signal includes. The feature value extracted by the feature extracting circuit 15 is sent to the coefficient control circuit 14. The coefficient control circuit 14 receives the compensation coefficient A(t) from the coefficient calculating circuit 11 and the feature value from the feature extracting circuit 15, and changes the duration of the compensation coefficient A(t) depending on the feature value so as to generate a new compensation coefficient G(t). Further, the coefficient control circuit 14 may change the amplitude of the compensation coefficient A(t) depending on the feature value. The compensation coefficient G(t) is used to define the length of a time period during which the input speech signal is amplified and the gain with which the input speech signal is amplified according to the feature value from the feature extracting circuit 15. The compensation coefficient G(t) can be obtained by holding the output of the compensation coefficient A(t) for a time period. The time period is determined depending on the feature value from the feature extracting circuit 15. The multiplier 13 receives the speech signal S(t) from the first delay circuit 12 and the compensation coefficient G(t) from the coefficient control circuit 14, end multiplies the speech signal S(t) by the compensation coefficient G(t), thereby to generate a speech signal y(t). Then, the entire contents in the first delay circuit 12 is delayed by one sample of each.

Now, how to calculate the compensation coefficients A(t) and G(t) will be described below in detail, referring to FIGS. 11 to 15.

Figure 11:
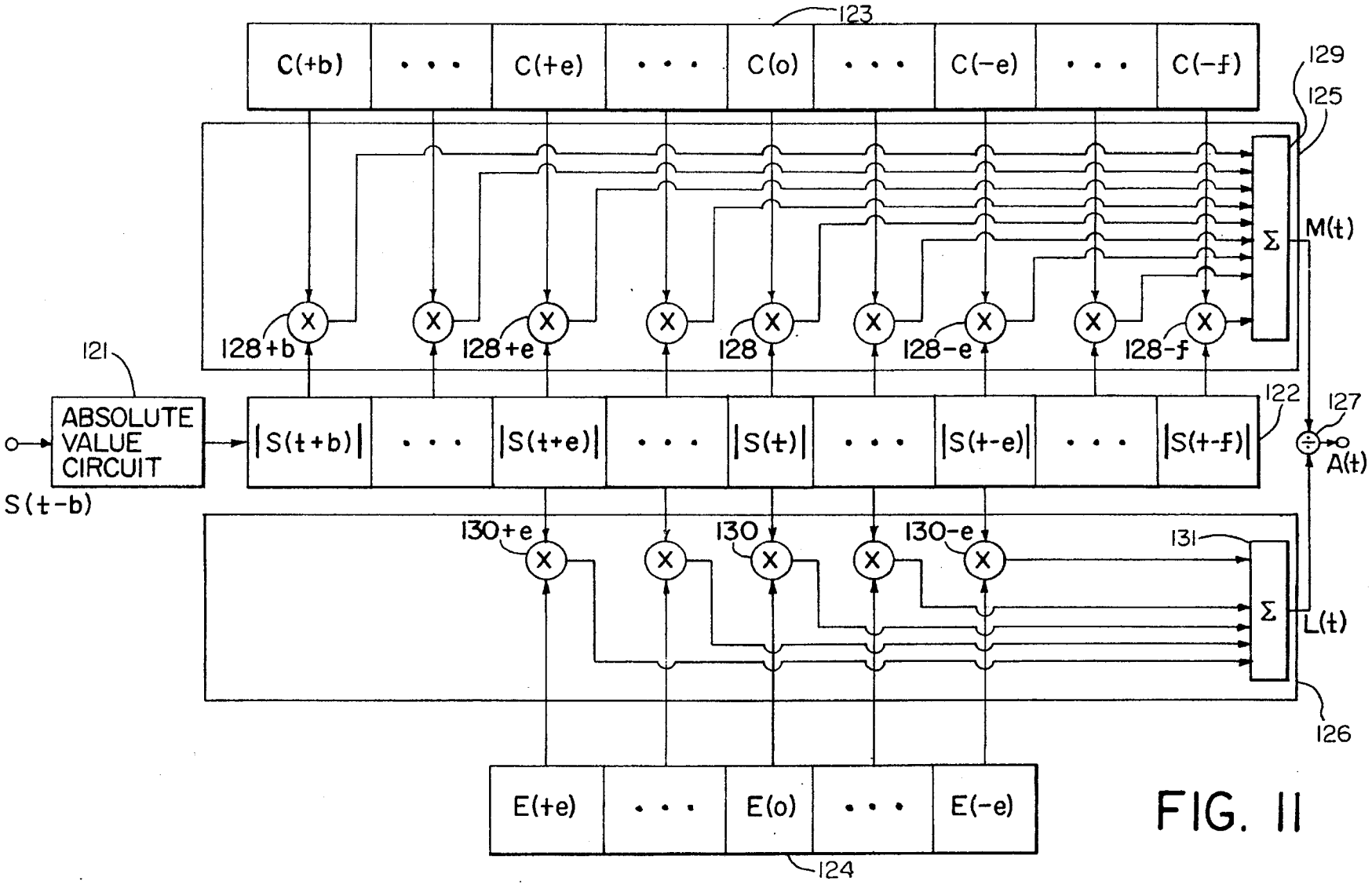
FIG. 11 is a structural diagram of coefficient calculating circuit of the apparatus for speech signal processing in the embodiment of the invention.

FIG. 11 shows the constitution of the coefficient calculating circuit 11 of the apparatus for speech signal processing in the embodiment of the invention. In FIG. 11, the reference numeral 121 is an absolute value circuit, 122 is an absolute value delay circuit, 123 is a first memory for storing the coefficient for calculating the value for suppressing the change of level of the input signal, 124 is a second memory for storing the coefficient for calculating the level of the input signal, 125 is a first convolutional operating circuit, 126 is a second convolutional operating circuit, 127 is a divider, 128+b to 128–f are multipliers, 129 is a summing circuit, 130+e to 130–e are multipliers, and 131 is a summing circuit.

In thus constituted coefficient calculating circuit of the apparatus for speech signal processing, its operation is described below.

First, the absolute value circuit 121 determines the absolute value of the input signal S(t+b), and produces it to the absolute value delay circuit 122. The absolute value delay circuit 122 stores the output of the absolute value circuit 121 at the time t and the time before end after it (|S(t+b)| to |S(t–f)|). The first convolutional operating circuit 125 performs a convolutional operation of the content of the absolute value delay circuit 122 (|S(t+b)| to |S(t–f)|) and the content of the first memory 123 (C(+b) to C(–f)) by using the multipliers 128+b to 128–f and the summing circuit 129, and finds the value M(t) for suppressing the change of level of the input signal before being normalized by the level. The second convolutional operating circuit 126 performs a convolutional operation of the content of the absolute value delay circuit 122 (|S(t+e)| to |S(t–e)|) and the content of the second memory 124 (E(+e) to E(–e)) by using the multipliers 130+e to 130–e and the summing circuit 131, thereby determining the level L(t) of the input signal at time t. The divider 127 divides the output M(t) of the first convolutional operating circuit 125 by the output L(t) of the second convolutional operating circuit 126, and produces the value A(t) for suppressing the change of level of the input signal. Finally the entire content in the absolute value delay circuit 122 is delayed by one sample each.

FIG. 12 shows the characteristic of the coefficient C(t) stored in the first memory for calculating the value M(t) for suppressing the level change of the input signal. This coefficient C(t) is shown in Equation (1). As shown in Equation (3), by convolving this coefficient C(t) into the absolute value of the input signal S(t), the value of M(t) becomes large when the level before and after the time t is larger than the level at the time t, and the value of M(t) becomes small when the level before and after the time t is smaller than the level at the time t, and therefore by multiplying M(t) by the input signal, the level of the input signal is smoothed. That is, the coefficient C(t) is the characteristic for differentiating in two steps with respect to the time axis. However, the coefficient C(t) is set so as to satisfy the condition of Equation (2) in order not to change the entire level.

$$C(t) = k_{\cdot} \cdot \exp(-t^2/2\sigma_{\cdot}^2) - k_i \cdot \exp(-t^2/2\sigma_i^2) \tag{1}$$

where, $k_{\cdot} < k_i, \sigma_{\cdot} > \sigma_i$ $$\sum_{i=+b}^{-b} C(i) = 1 \tag{2}$$

$$M(t) = \sum_{i=+b}^{-b} C(i) \cdot |s(t+i)| \tag{3}$$

FIG. 13 shows another characteristic of the coefficient C(t) stored in the first memory in order to calculate the value M(t) for suppressing the level change of the input signal. This coefficient is shown in Equation (4). As shown in this diagram, by making the coefficient C(t) asymmetrical with respect to the time axis, the temporal masking of auditory sense is securely compensated. As shown in Equation (6), by convolving this coefficient C(t) into the absolute value of the input signal S(t), the value of M(t) becomes large when the level before end after the time t is larger than the level at the time t, and the value of M(t) becomes small when the level before and after the time t is smaller than the level at the time t, and therefore by multiplying M(t) and the input signal, the level of the input signal is smoothed. That is, the coefficient C(t) is the characteristic for differentiating in two steps with respect to the time axis. However, the coefficient C(t) is set so as to satisfy the condition of Equation (5) in order not to change the entire level.

$$C(t) = k_{ef} \cdot \exp(-t^2/2\sigma_{ef}^2) - k_{if} \cdot \exp(-t^2/2\sigma_{if}^2)\ t \leqq 0$$

$$C(t) = k_{eb} \cdot \exp(-t^2/2\sigma_{eb}^2) - k_{ib} \cdot \exp(-t^2/2\sigma_{ib}^2)\ t > 0$$

$$\text{where}\quad k_{ef} < k_{if},\ \sigma_{ef} > \sigma_{if}$$
$$k_{eb} < k_{ib},\ \sigma_{eb} > \sigma_{ib}$$
$$k_{ef} < k_{eb},\ k_{if} > k_{ib}$$
$$\sigma_{ef} < \sigma_{eb},\ \sigma_{if} > \sigma_{ib} \tag{4}$$

$$\sum_{i=+b}^{-f} C(i) = 1 \tag{5}$$

$$M(t) = \sum_{i=+b}^{-f} C(i) \cdot |s(t+i)| \tag{6}$$

FIG. 14 shows another characteristic of the coefficient C(t) stored in the first memory for calculating the value M(t) for suppressing the level change of the input signal. This coefficient C(t) is shown in Equation (7). As known from this diagram, by limiting the coefficient C(t) only on the positive time axis, the amplification in the silent sectional after vowel is decreased and the quantity of calculation is smaller. As shown in Equation (9), by convolving this coefficient C(t) into the absolute value of the input signal S(t), the value of M(t) becomes large when the level after the time t is larger than the level at the time t, and the value of M(t) becomes small when the level after the time t is smaller than the level at the time t, and therefore by multiplying M(t) and the input signal, the level of the input signal is smoothed. That is, the coefficient C(t) has the characteristic of differentiating the rise of the input signal in two steps with respect to the time axis. However, the coefficient C(t) is set so as to satisfy the condition in Equation (8) in order not to change the entire level.

$$C(t) = k_e \cdot \exp(-t^2/2\sigma_e^2) - k_i \cdot \exp(-t^2/2\sigma_i^2) \tag{7}$$

$$\text{where, } k_e < k_i,\ \sigma_e > \sigma_i,\ t \leqq 0$$

$$\sum_{i=+b}^{\sigma} C(i) = 1 \tag{8}$$

$$M(t) = \sum_{i=+b}^{\sigma} C(i) \cdot |s(t+i)| \tag{9}$$

FIG. 15 shows the characteristic of the coefficient E(t) stored in the second memory for determining the level of the input signal. This coefficient E(t) is shown in equation (10). As shown in Equation (12), by convolving this coefficient E(t) into the absolute value of the input signal, the absolute value of the input signal is smoothed, and the level of the input signal may be determined. That is, the coefficient E(t) is the characteristic for integrating on the time axis. However, in order not to change the entire level, the coefficient E(t) is set so as to satisfy the condition of Equation (11).

$$E(t) = k_n \cdot \exp(-t^2/2\sigma_n^2) \tag{10}$$

$$\sum_{i=+e}^{-e} E(i) = 1 \tag{11}$$

$$L(t) = \sum_{i=+e}^{-e} E(i) \cdot |s(t+i)| \tag{12}$$

In the following Equation (13), the value G(t) of applying the parameter α to A(t) is determined.

$$G(t) = A(t) \qquad \text{if } G(t-1) \leqq A(t)$$
$$G(t) = \alpha \cdot G(t-1) \qquad \text{if } G(t-1) > A(t)$$

-continued $$\text{where } 0 < \alpha < 1 \tag{13}$$

The parameter α is determined depending on the feature value, such as the kind of plosives or the kind of fricatives. When the parameter α is smaller, the duration of the value G(t) will be longer. On the other hand, when the parameter α is larger, the duration of the value G(t) will be shorter.

FIGS. 2A To 2D show waveforms respectively representing the original speech signal S(t) output from the first delay circuit 12, the compensation coefficient A(t) output from the coefficient calculating circuit 11, the compensation coefficient G(t) output from the coefficient control circuit 14, and the speech signal y(t) output from the multiplier 13.

Figure 3:
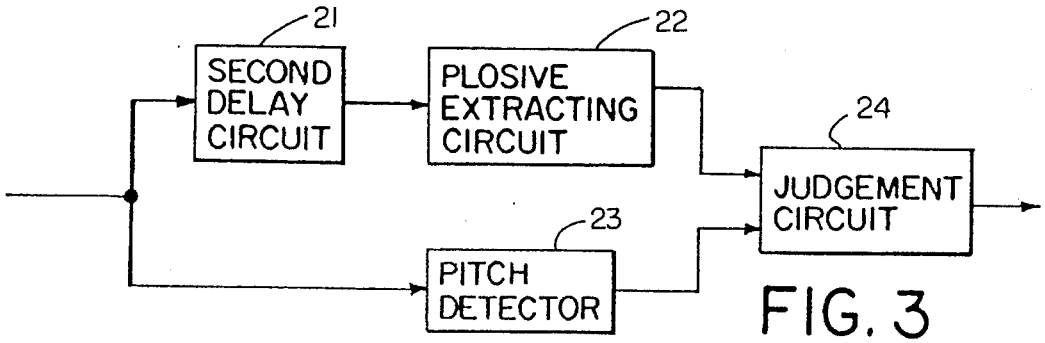
FIG. 3 is a block diagram of a feature extracting circuit for the speech signal processing apparatus of FIG. 1.

FIG. 3 is a block diagram of the feature extracting circuit 15 for the speech signal processing apparatus of this embodiment of the present invention. Referring to FIG. 3, the feature extracting circuit 15 includes a second delay circuit 21 for delaying the input speech signal, a plosive extracting circuit 22 for deriving a feature value representing a feature of a plosive component from the speech signal, a pitch detector 23 for detecting the pitch of the speech signal, and a judgement circuit 24 for determining whether the speech signal is a plosive or not based on the output from the plosive extracting circuit 22 and the pitch detector 23.

The operation of the above feature extracting circuit 15 will be described.

The input speech signal is sent to the second delay circuit 21 and the pitch detector 23. The second delay circuit 21 receives the input speech signal, and delays the speech signal by a time d to output a delayed signal to the plosive extracting circuit 22. The plosive extracting circuit 22 receives the delayed signal, and derives a feature value representing a feature of a plosive component from the speech signal. The feature value extracted by the plosive extracting circuit 22 is sent to the judgement circuit 24. The feature value indicates whether the input speech signal includes a plosive or not. Further, the feature value may indicate what kind of plosives the input speech signal includes. The pitch detector 23 calculates the pitch frequency of the speech signal to determine whether the speech signal is sound or silent. The output from the pitch detector 23 may indicate whether there exists a vowel after a consonant in the signal speech signal. The output from the pitch detector 23 is also sent to the Judgement circuit 24. The judgement circuit 24 receives the feature value from plosive extracting circuit 22 and the output from the pitch detector 23, and determines whether the feature value passes through the judgement circuit 24 depending on the output from the pitch detector 23. As a result, when both the output from the plosive extracting circuit 22 and the output from the pitch detector 23 are truth, the judgement circuit 24 outputs a signal indicating whether the input speech signal includes a plosive or not. Further, the judgement circuit 24 may output a signal indicating the kind of plosives in the input speech signal.

Thus, according to this embodiment of the present invention, the feature value indicating whether a plosive included in the input speech signal or not can be detected. Further, the feature value indicating what kind of plosives is included in the input speech signal can be detected. This makes it possible to control the duration of the compensation coefficient depending on the kinds of consonants used such as plosives and fricatives. As a result, a speech signal processing apparatus can be provided which can control the compensation coefficient for providing the appropriate length of time period during which the input speech signal is to be amplified, depending on the kinds of the consonants having different VOTs.

Further, according to the feature extracting circuit 15 of this embodiment of the present invention, only a plosive pronounced immediately before a vowel is detected. This prevents other components of the speech signal from being mistakenly detected. It is possible that the feature extracting circuit 15 consists of only the plosive extracting circuit 22. According to such a configuration, it is expected that the entire delay time due to the processing can be reduced, but the number of errors are increased.

EXAMPLE 2

Figure 4:
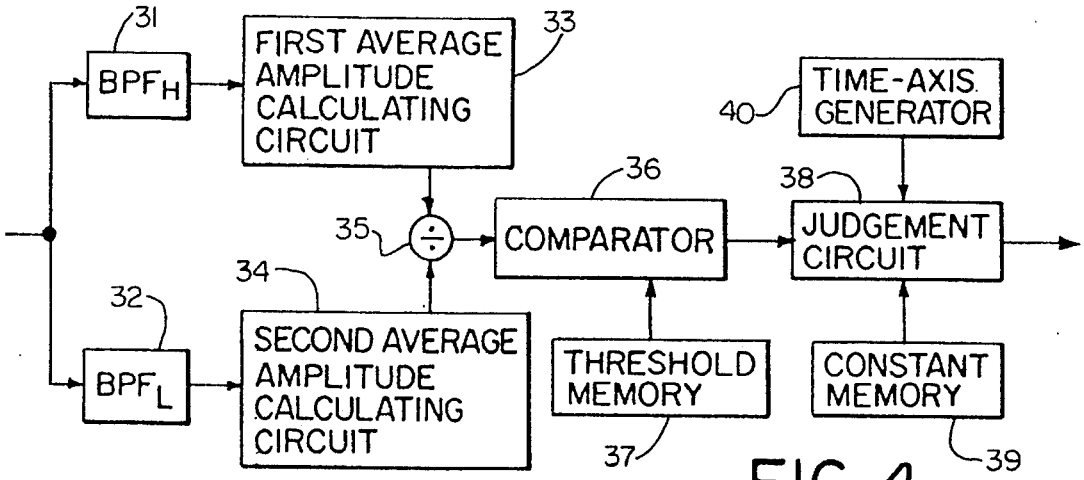
FIG. 4 is a block diagram of a plosive feature extracting circuit according to the present invention.

FIG. 4 shows a block diagram of a plosive extracting circuit according to the present invention. Referring to FIG. 4, the plosive extracting circuit includes a first band pass filter ($BPF_H$) 31 which allows components of a speech signal having middle to high frequencies (hereinafter referred to as higher-frequency components) to pass therethrough, a second band pass filter ($BPF_L$) 32 which allows components thereof having low to middle frequencies (hereinafter referred to as lower-frequency components) to pass therethrough, and first and second average amplitude calculating circuits 33 and 34 for calculating an average amplitude in a short time period.

The plosive extracting circuit further includes a divider 35, a threshold memory 37 for storing a constant as a threshold, a comparator 36 for comparing the output from the divider 35 with the output from the threshold memory 37, a constant memory 39 for storing durations of plosives and the like, a time-axis generator 40 for generating a clock signal, and judgement circuit 38 for identifying the kind of plosives by comparing the output from the comparator 36 with the output from the constant memory 39 on the basis of the clock signal output from the time-axis generator 40.

The operation of the above plosive extracting circuit will be described.

An input speech signal is sent to the $BPF_H$ 31 and the $BPF_L$ 32. The $BPF_H$ 31 allows higher-frequency components having a frequency in the range of 3.7 to 5 kHz, for example, to pass therethrough. The $BPF_L$ 32 allows lower-frequency components having a frequency in the range of 100 to 900 kHz, for example, to pass therethrough. The speech signals filtered through the $BPF_H$ 31 and the $BPF_L$ 32 are then sent to the first and the second average amplitude calculating circuits 33 and 34, respectively, where an average amplitude for a predetermined short time period is calculated. Then, the output from the first average amplitude calculating circuit 33 is divided by the output from the second average amplitude calculating circuit 34 by the divider 35, in order to obtain the ratio of the short-period average amplitude of the higher-frequency components to that of the lower-frequency components.

The threshold memory 37 stores a predetermined constant as a threshold. The comparator 36 compares the output from the divider 35 with the output from the threshold memory 37 so as to determine whether the former exceeds the latter or not, and sends the resulting data to the judgement circuit 38. The resulting data is represented by either one of two values. Specifically, only when the output from divider 35 exceeds the constant stored in the threshold memory 37, the resulting data is a high value (e.g., 1), and otherwise the resulting data is a low value (e.g., 0). The constant memory 39 stores constants $t_1$, $t_2$, and $t_3$ corresponding to the durations of the plosives, /p/, /t/, and /k/, respectively. The time-axis generator 40 generates a clock signal having a predetermined cycle.

The judgement circuit 38 compares the output from the comparator 36 with the output from the constant memory 39 on the basis of the clock signal output from the time-axis generator 40, and determines how long the ratio continues to exceed the threshold, thereby to identify the plosive. In this example, the plosive is identified as /p/ when the high value output from the comparator 36 lasts for a period less than or equal to $t_1$, as /t/ when the high value output from the comparator 36 lasts for a period less than or equal to $t_2$ but greater than $t_1$, and as /k/ when the high value output from the comparator 36 lasts for a period less than or equal to $t_3$ but greater than $t_2$. When the high value output from the comparator 36 lasts for a period greater than $t_3$, it is determined that the speech signal is not a plosive.

Figure 16:
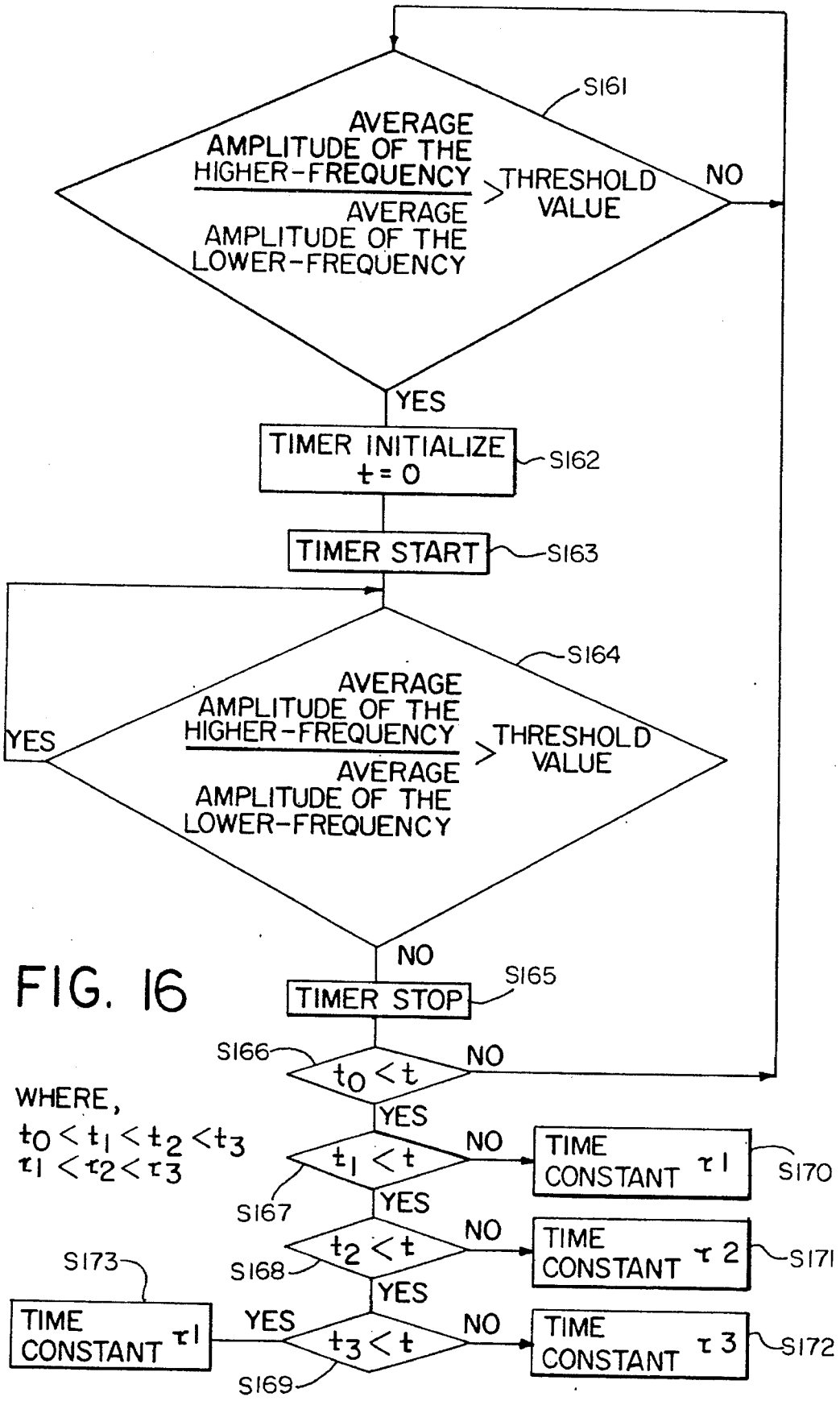
FIG. 16 is a flowchart showing a process of extracting the kind of plosives from the input signal.

FIG. 16 shows the process of extracting the kind of plosives from the input speech signal, using the plosive extracting circuit mentioned above. In step S161, the ratio of the short-period average amplitude of the higher-frequency components to that of the lower-frequency components is compared with a threshold value stored in the threshold memory 37. If Yes in step S161, then a timer is initialized and starts (steps S162 and S163). The timer is used to measure how long the ratio continues to exceed the threshold value. While the ratio exceeds the threshold value, step S164 is repeated, and a time measured by the timer proceeds. If NO in step S164, the timer stops to measure the time so as to obtain a time period t which indicates how long the ratio continues to exceed the threshold value. If the time period t complies with $t_0<t\leqq t_1$, then a time constant is set to $t_1$ (steps S166, S167 and S170). If the time period t complies with $t_1<t\leqq t_2$, then a time constant is set to t2 (steps S167, S168 and S171). If the time period t complies with $t_2<t\leqq t_3$, then a time constant is set to t3 (steps S168, S169 and S172). If the time period t complies with $t_3<t$, then a time constant is set to t1 (steps S169 and S173), where, t1<t2<t3, and $t_0<t_1<t_2<t_3$.

Figures 17, 18A, 18B, 18C, 18D:
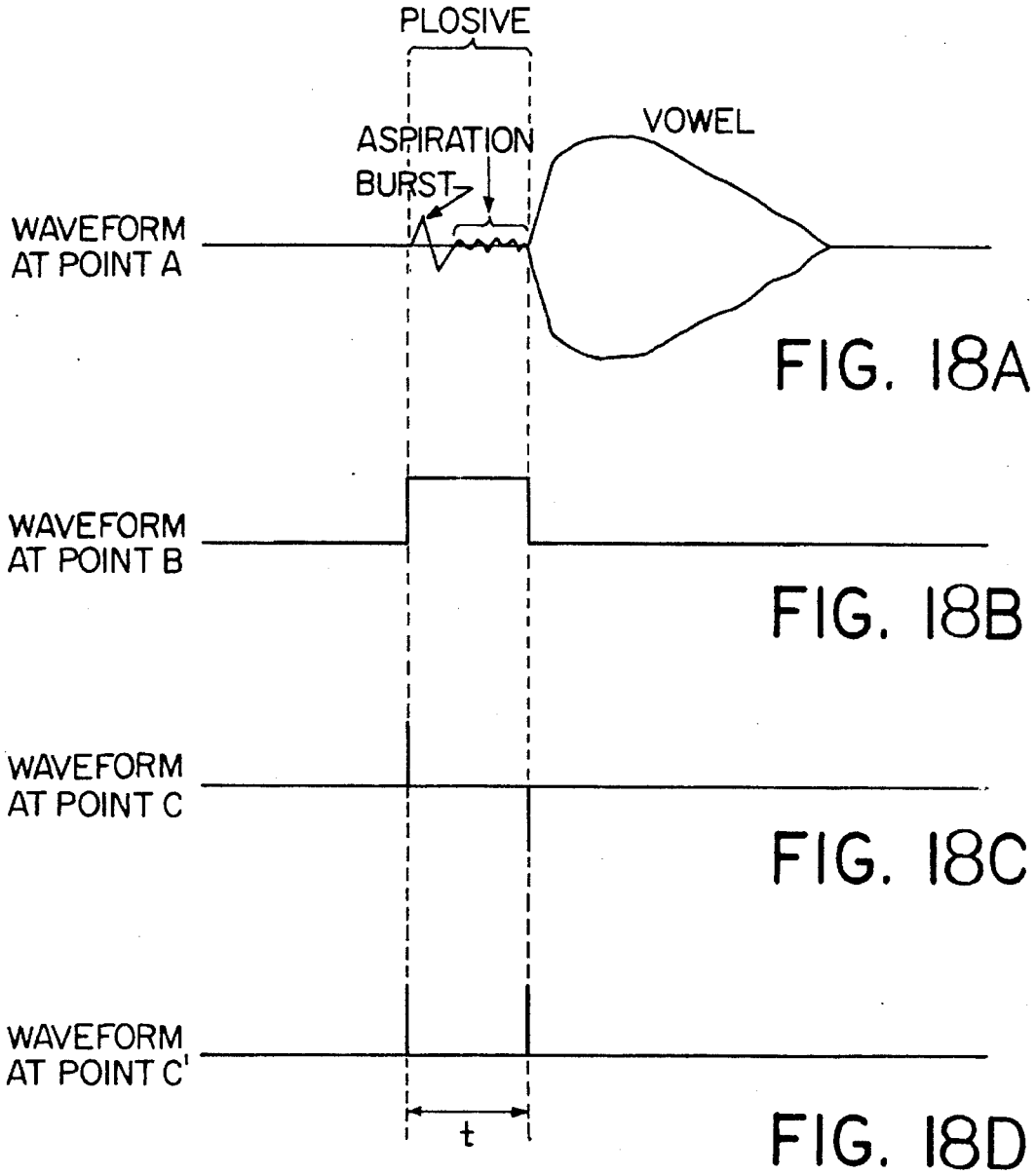
FIG. 17 is a table represents a relationship between plosives and time constants.
FIGS. 18A to 18D are schematic diagrams showing waveforms of a speech signal at different stages in the process by the speech signal processing apparatus of FIG. 5.

FIG. 17 shows a relationship between plosives and time constants. Specifically, the plosive /p/ corresponds to the time constant t1, the plosive /t/ corresponds to the time constant t2, and the plosive /k/ corresponds to the time constant t3, where t1<t2<t3. The values of the parameter $\alpha$ in the Equation (13) mentioned above may be changed according to the time constants t1, t2 end t3, respectively.

Thus, according to this embodiment of the present invention, the contrast of the ratio of the average amplitude in a short time period of higher-frequency components of an input speech signal to that of lower-frequency components thereof is calculated with time. This makes it possible to detect a silent plosive and to identify the kind of the detected plosive. As a result, there can be provided a plosive extracting circuit in which time periods corresponding to the silent plosives, /p/, /t/, and /k/ having different VOTs can be allocated.

EXAMPLE 3

Figure 5:
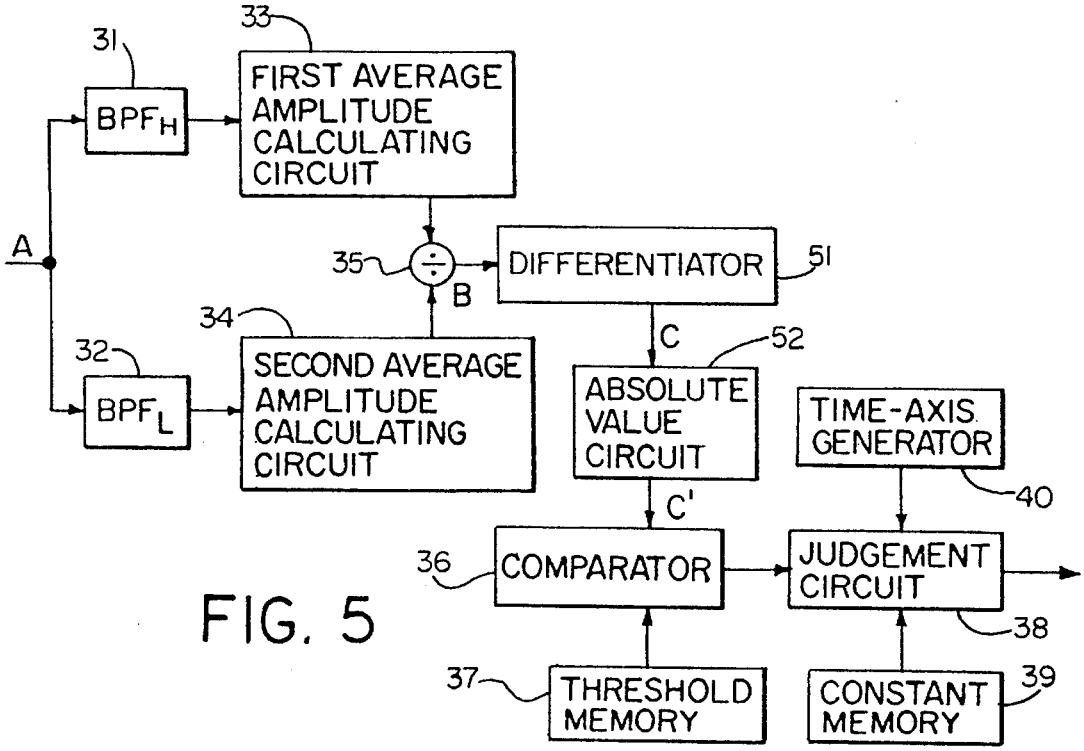
FIG. 5 is a block diagram of another plosive feature extricating circuit according to the present invention.
Figure 8A:
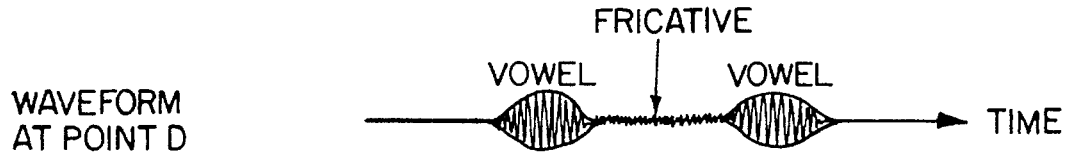
FIGS. 8A to 8D are waveforms of a speech signal at different stages in the process by the speech signal processing apparatus of FIG. 7.
Figure 8B:
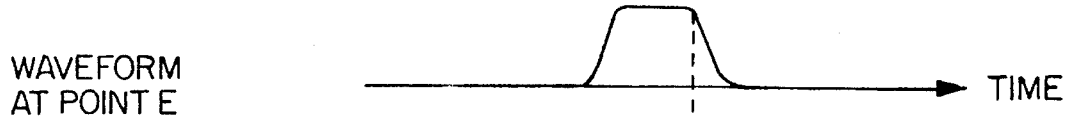
Figure 8C:
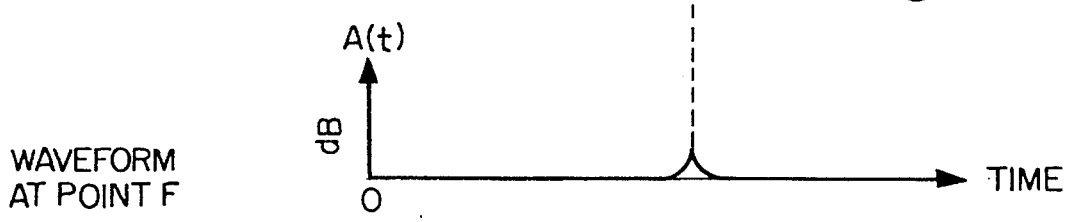
Figure 8D:
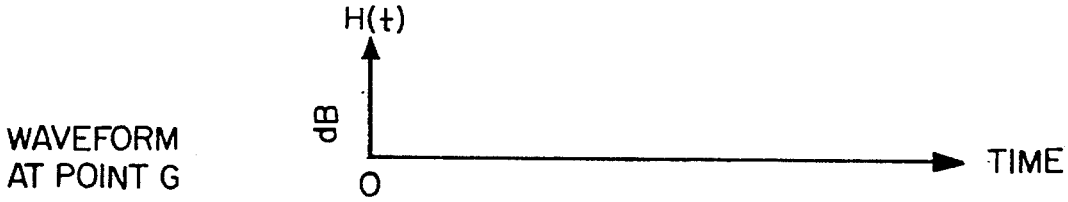
Figure 9:
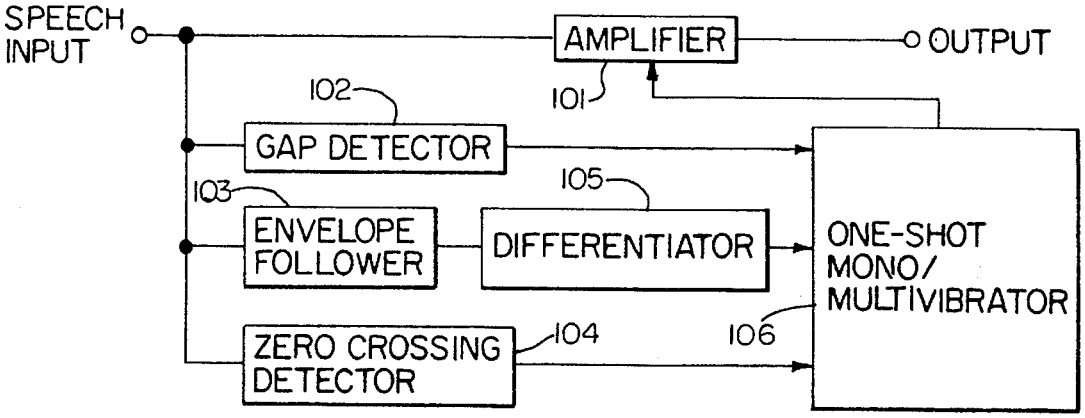
FIG. 9 PRIOR ART
FIG. 9 is a block diagram of a conventional speech signal processing apparatus.

FIG. 5 shows a block diagram of another plosive extracting circuit according to the present invention. The plosive extracting circuit of this example has the same configuration as that of Example 2, except that it further includes a differentiator 51 for differentiating the signal output from the divider 35 with regard to a time axis, and an absolute value circuit 52 for calculating an absolute value of the differentiated signal.

The operation of the above-described plosive extracting circuit will be described.

An input speech signal is sent to the $BPF_H$ 31 and the $BPF_L$ 32. The $BPF_H$ 31 allows higher-frequency components having a frequency in the range of 3.7 to 5 kHz, for example, to pass therethrough. The $BPF_L$ 32 allows lower-frequency components having a frequency in the range of 100 to 900 kHz, for example, to pass therethrough. The speech signals filtered through the $BPF_H$ 31 and the $BPF_L$ 32 are then sent to the first and the second average amplitude calculating circuits 33 and 34, respectively, where an average amplitude for a predetermined short time period is calculated. Then, the output from the first average amplitude calculating circuit 33 is divided by the output from the second average amplitude calculating circuit 34 by the divider 35, thus to obtain the ratio of the short-period average amplitude of the higher-frequency components to that of the lower-frequency components.

The differentiator 51 receives the signal from the divider 35, and differentiates the received signal second times with respect to the time axis. The absolute value circuit 52 receives the differentiated signal, and generates an absolute value of the differentiated signal. The threshold memory 37 stores a predetermined constant as a threshold.

The comparator 36 compares the output from the absolute value circuit 52 with the output from the threshold memory 37 so as to determine whether the former exceeds the latter or not, end sends the resulting data to the judgement circuit 38. The resulting data is represented by either one of two values. Specifically, only when the output from absolute value circuit 52 exceeds the constant stored in the threshold memory 37, the resulting date is a high value (e.g., 1), and otherwise the resulting data is a low value (e.g., 0). The constant memory 39 stores constants $t_1$, $t_2$, and $t_3$ corresponding to the durations of the plosives, /p/, /t/, and /k/, respectively. The time-axis generator 40 generates a clock signal having a predetermined cycle.

The judgement circuit 38 compares the output from the comparator 36 with the output from the constant memory 39 on the basis of the clock signal output from the time-axis generator 40, and determines how long the absolute value continues to exceed the threshold, thereby to identify the plosive. In this example, the plosive is identified as /p/ when the high value output from the comparator 36 lasts for a period less than or equal to $t_1$, as /t/ when the high value output lasts for a period less than or equal to $t_2$ but greater than $t_1$, and as /k/ when the high value output lasts for a period less than or equal to $t_3$ but greater than $t_2$. When the high value output lasts for a period greater than $t_3$, it is determined that the speech signal is not a plosive.

FIGS. 6A to 6C show waveforms respectively representing the input speech signal at point A shown in FIG. 5, the ratio of the short-period average amplitude of higher-frequency components to that of lower-frequency components at point B shown in FIG. 5, and the result of the differentiation with respect to the time axis by the differentiator 51 at point C shown in FIG. 5.

FIGS. 18A to 18D more schematically show waveforms at points A, B, C and C' shown in FIG. 5, respectively. The point C' indicates the output from the absolute value circuit 52. Generally, the input signal may include a consonant and a vowel. When the consonant is a plosive, the plosive includes a burst component and an aspiration component, as shown in FIG. 18A. The time period t shown in FIGS. 18A to 18D is different depending on the kind of plosives such as /p/, /t/ and /k/. As mentioned above, the plosive feature extraction circuit according to the present invention can detect the time period t, thereby identifying the kind of plosives.

Thus, according to this embodiment of the present invention, the contrast of the ratio of the average amplitude in a short time period of higher-frequency components of an input speech signal to that of lower-frequency components thereof is emphasized, and such an emphasized ratio is calculated with time. This makes it possible to detect a silent plosive and to identify the kind of the detected plosive. As a result, a plosive extracting circuit can be provided in which time periods corresponding to the silent plosives, /p/, /t/, and /k/ having a small amplitude and different VOTs can be allocated.

EXAMPLE 4

FIG. 7 shows a block diagram of another speech signal processing apparatus according to the present invention. In this example, the same components as those in the previous examples are denoted as the same reference numerals, and the description thereof is omitted. In this example, the reference numeral 60 is a coefficient control circuit which outputs a value 1 as the compensation coefficient when it receives data from the judgement circuit 38, and the reference numeral 61 is a zero crossing detector for calculating the zero crossing frequency.

The operation of the speech signal processing apparatus of this example will be described.

An input signal S(t–b) is sent to the coefficient calculating circuit 11, the first delay circuit 12, and the zero crossing detector 61. The coefficient calculating circuit 11 receives the input speech signal S(t–b), and calculates a compensation coefficient A(t) on the basis of the speech signal at the time t and just before and after the time t so as to suppress the change of the level of a speech signal S(t). The first delay circuit 12 receives the input speech signal S(t–b), and delays the input speech signal S(t–b) by the time b required for the processing of the signal so as to output the speech signal S(t).

The zero crossing detector 61 receives the input speech signal S(t–b), and detects the zero crossing frequency of the speech signal. The threshold memory 37 stores a predetermined constant as a threshold. The comparator 36 compares the output from the zero crossing detector 61 with the output from the threshold memory 37 so as to determine whether the former exceeds the latter or not, and sends the resulting data to the judgement circuit 38. The resulting data is represented by either one of two values. Specifically, only when the output from the zero crossing detector 61 exceeds the constant stored in the threshold memory 37, the resulting data is a high value (e.g., 1), and otherwise the resulting data is a low value (e.g., 0). The constant memory 39 stores a constant $t_4$ corresponding to a predetermined time period. The time-axis generator 40 generates a clock signal having a predetermined cycle. The judgement circuit 38 compares the output from the comparator 36 with the output from the constant memory 39 on the basis of the clock signal output from the time-axis generator 40. When the high value output from the comparator 36 lasts for a period greater than $t_4$, the speech signal is determined to be a fricative.

When the coefficient control circuit 60 receives no data from the judgement circuit 38, it allows the compensation coefficient A(t) received from the coefficient calculating circuit 11 to pass therethrough to be output as the compensation coefficient H(t). When the coefficient control circuit 60 receives data from the judgement circuit 38, it outputs 1 as the compensation coefficient H(t). The multiplier 13 multiplies the output from the first delay circuit 12 by the compensation coefficient H(t) output from the coefficient control circuit 60, thereby to output a speech signal y(t). Then, the entire content in the first delay circuit 12 is delayed by one sample each.

FIGS. 8A to 8D show waveforms respectively representing the original speech signal S(t) output from the first delay circuit 12 at point D shown in FIG. 7, the zero crossing frequency output from the zero crossing detector 61 at point E shown in FIG. 7, the compensation coefficient A(t) output from the coefficient calculating circuit 11 at point F shown in FIG. 7, and the compensation coefficient H(t) output from the coefficient control circuit 60 at point G shown in FIG. 7.

Thus, according to this embodiment of the present invention, the duration of a fricative is detected and the coefficient calculating circuit 11 outputs 1 as the compensation coefficient H(t) for a time period corresponding to this duration. As a result, the trouble of producing a different sound from the original sound caused by partially amplifying a long-duration fricative can be prevented.

As described above, according to the present invention, a plosive in speech can be detected, and the duration of the compensation coefficient to be applied can be properly controlled depending on the kind of plosives so that the plosives can be stably emphasized. Further, by providing the pitch detector and the second delay circuit, only a plosive pronounced immediately before a vowel can be detected, thus preventing mistakenly amplifying other components of the speech signal. Moreover, by providing the zero crossing detector, partial amplification of a fricative is avoided so that the trouble of producing a different sound from the original can be prevented.

Accordingly, the speech signal processing apparatus of the present invention can amplify plosives without spoiling the naturalness of the speech, thereby improving the intelligibility of the speech. Such a speech signal processing apparatus, therefore, will be greatly effective when it is put into practical use.

Various other modifications wall be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An apparatus for processing a speech signal, comprising:

feature extracting means for receiving an input signal and for deriving a feature value representing a feature of consonants from said input signal, said feature extracting means comprising first determining means for determining a time constant based on said derived feature value;

second determining means for determining a parameter for specifying a time period during which said input signal is amplified, based on said time constant, and for specifying a gain with which said input signal is amplified, based on said time constant; and amplifying means for amplifying said input signal based on said parameter.

2. An apparatus according to claim 1, wherein said feature value represents kinds of plosives.

3. An apparatus according to claim 1, wherein said feature value represents kinds of fricatives.

* * * * *